US008784127B2

(12) United States Patent
Bashkin et al.

(10) Patent No.: US 8,784,127 B2
(45) Date of Patent: Jul. 22, 2014

(54) ELECTRICAL CONNECTION SYSTEM INCLUDING MATING ASSIST LEVER THAT CONTAINS LOCKING MEANS AND CONNECTOR POSITION ASSURANCE MEMBER THAT INTERACTS THEREWITH

(75) Inventors: Michael Bashkin, Aurora, OH (US); Bart N. Caldwell, West Farmington, OH (US); James D. Daugherty, Brookfield, OH (US)

(73) Assignee: Delphi Technologies, Inc., Troy, MI (US)

( * ) Notice: Subject to any disclaimer, the term of this patent is extended or adjusted under 35 U.S.C. 154(b) by 164 days.

(21) Appl. No.: 13/493,124

(22) Filed: Jun. 11, 2012

(65) Prior Publication Data

US 2013/0330959 A1 Dec. 12, 2013

(51) Int. Cl.
*H01R 13/62* (2006.01)

(52) U.S. Cl.
USPC ..... 439/372

(58) Field of Classification Search
USPC ..... 439/372, 157, 308
See application file for complete search history.

(56) References Cited

U.S. PATENT DOCUMENTS 5,178,553 A * 1/1993 Hatagishi et al. ..... 439/157
5,230,635 A * 7/1993 Takenouchi et al. ..... 439/157
5,344,194 A * 9/1994 Hatagishi et al. ..... 285/26
5,474,462 A * 12/1995 Yamanashi ..... 439/157
5,476,391 A * 12/1995 Katsuma ..... 439/157
5,551,885 A * 9/1996 Yamanashi et al. ..... 439/157
5,775,930 A 7/1998 Model et al.
5,947,763 A 9/1999 Alaksin
6,305,957 B1 10/2001 Fink et al.
6,439,902 B1 * 8/2002 Cole et al. ..... 439/157
6,644,992 B2 * 11/2003 Maegawa ..... 439/157
6,824,406 B1 11/2004 Sharples
7,137,844 B2 11/2006 Flowers et al.
7,241,156 B1 7/2007 Margrave et al.
7,241,183 B2 7/2007 Wasalaski et al.
7,258,557 B2 * 8/2007 Matsubara et al. ..... 439/157
7,347,743 B2 3/2008 Daugherty et al.
7,361,036 B2 4/2008 Pittenger et al.
7,419,390 B2 * 9/2008 Ohtaka et al. ..... 439/157
7,442,058 B2 * 10/2008 Ohtaka et al. ..... 439/157
7,481,661 B2 1/2009 Takahashi et al.
7,537,469 B2 * 5/2009 Takahashi et al. ..... 439/157
7,695,297 B2 * 4/2010 Pittenger et al. ..... 439/157

(Continued)

OTHER PUBLICATIONS

European Search Report dated May 14, 2014.

*Primary Examiner* — Amy Cohen Johnson
*Assistant Examiner* — Vladimir Imas
(74) *Attorney, Agent, or Firm* — Robert J. Myers

(57) ABSTRACT

An electrical connection system and method includes a first connector housing matable to a second connector housing along a mating axis. The first connector housing contains a mating assist lever (MAL) that rotationally pivots between an INOPERATIVE position and a CLOSED position and includes a locking means. When the MAL is positionally rotatable to the CLOSED position the first connector housing and the second connector housing are mated together such that the locking means is disposed adjacent an external surface of the second connector housing. A sufficiently applied force against the locking means actuates the locking means so that the locking means latchingly secures the first connector housing to the second connector housing. A CPA member, also disposed on the MAL, slidingly communicates with the latched locking means transverse to the mating axis and ensures the latched locking means does not become unlatched so that electrical connection system remains mated.

22 Claims, 7 Drawing Sheets

(56) References Cited

U.S. PATENT DOCUMENTS

| | | | | |
|---|---|---|---|---|
| 7,794,247 | B2 * | 9/2010 | Suzuki | 439/157 |
| 7,909,638 | B2 * | 3/2011 | Seo et al. | 439/489 |
| 7,955,110 | B1 * | 6/2011 | Kataoka et al. | 439/284 |
| 8,202,116 | B2 * | 6/2012 | Suzuki et al. | 439/607.01 |
| 8,272,891 | B2 * | 9/2012 | Kataoka et al. | 439/540.1 |
| 8,282,411 | B2 * | 10/2012 | Itzenhuiser et al. | 439/489 |
| 2003/0022539 | A1 * | 1/2003 | Takahashi | 439/157 |
| 2007/0128900 | A1 | 6/2007 | Bauman et al. | |
| 2007/0184692 | A1 * | 8/2007 | Ohtaka et al. | 439/157 |

* cited by examiner

ELECTRICAL CONNECTION SYSTEM INCLUDING MATING ASSIST LEVER THAT CONTAINS LOCKING MEANS AND CONNECTOR POSITION ASSURANCE MEMBER THAT INTERACTS THEREWITH

TECHNICAL FIELD OF THE INVENTION

This invention relates to an electrical connection system, more particularly, an electrical connection system includes a mating assist lever (MAL) that contains a locking means and a connector position assurance (CPA) member that operatively work in combination to allow mating and unmating of the levered electrical connection system being especially suited for electrical applications having limited mating space.

BACKGROUND OF THE INVENTION

Lever arm electrical connection systems are used to electrically connect electrical devices together in an electrical application.

In many electrical applications the physical space to mate and/or unmate connector housings of the lever arm electrical connection system is free from obstructions from other structures in any direction away from the mating axis of the lever arm electrical connection system. This allows for easy mating and unmating of the connector housings in the lever arm electrical connection system. Increasingly, however, the predetermined allocated mating space needed to mate and unmate a lever arm electrical connection system in vehicular applications is becoming more limited, or constrained about the mating axis of the lever arm electrical connection system. Yet the need remains to provide robust lever arm connection systems that are easily mated or unmated in these constrained space environments.

Thus, what is needed is a lever arm electrical connection system that includes a mating assist lever (MAL) that performingly operates in a shorter rotation space and also provides easy access to both a locking means and a connector position assurance (CPA) member that operatively work in combination to allow unencumbered, multiple matings and unmatings of the connector housings of the lever arm electrical connection system, especially in applications having a constrained space environment.

BRIEF SUMMARY OF THE INVENTION

In accordance with one embodiment of the invention, an electrical connection system including a first connector housing containing associated electrical contacts and a second connector housing containing associated mating electrical contacts. The first connector housing and associated mating contacts are configured to mate with the second connector housing and the second connector housing's electrical contacts along a mating axis. The first connector housing further includes a mating assist lever (MAL) pivotally mounted to the first connector housing and configured to rotationally pivot between an INOPERATIVE position and a CLOSED position. The MAL includes a locking means disposed thereon. When the MAL is rotated to the CLOSED position so that the first connector housing and the second connector housing are fully mated together, the locking means is disposed adjacent an external surface of the second connector housing. A force sufficiently applied against the locking means actuates the locking means so that the locking means latchingly secures the first connector housing to the second connector housing.

In accordance to another embodiment of the invention, a method of mating a first connector housing to a second connector housing to form an electrical connection system is presented. One step in the method is matingly engaging the first connector housing to the second connector housing along a mating axis. The first connector housing includes a mating assist lever (MAL) that contains a connector position assurance (CPA) member and a locking means. The MAL is configured to movingly rotate to a CLOSED position and the CPA member is configured to slidingly move to a LOCKED position. Another step in the method is movingly rotating the MAL to the CLOSED position such that the locking means is disposed adjacent to an external surface of the second connector housing. Another step in the method is applying a force against the locking means when the MAL is disposed in the CLOSED position that is sufficient to latchingly secure the first connector housing to the second connector housing. A further step in the method is slidably moving the CPA member so that the CPA member is disposed in the LOCKED position such that the CPA member communicates with the latched locking means in a manner to prevent the latched locking means from being unlatched.

Further features, uses and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

This invention will be further described with reference to the accompanying drawings in which.

DETAILED DESCRIPTION OF THE INVENTION

Figure 1:
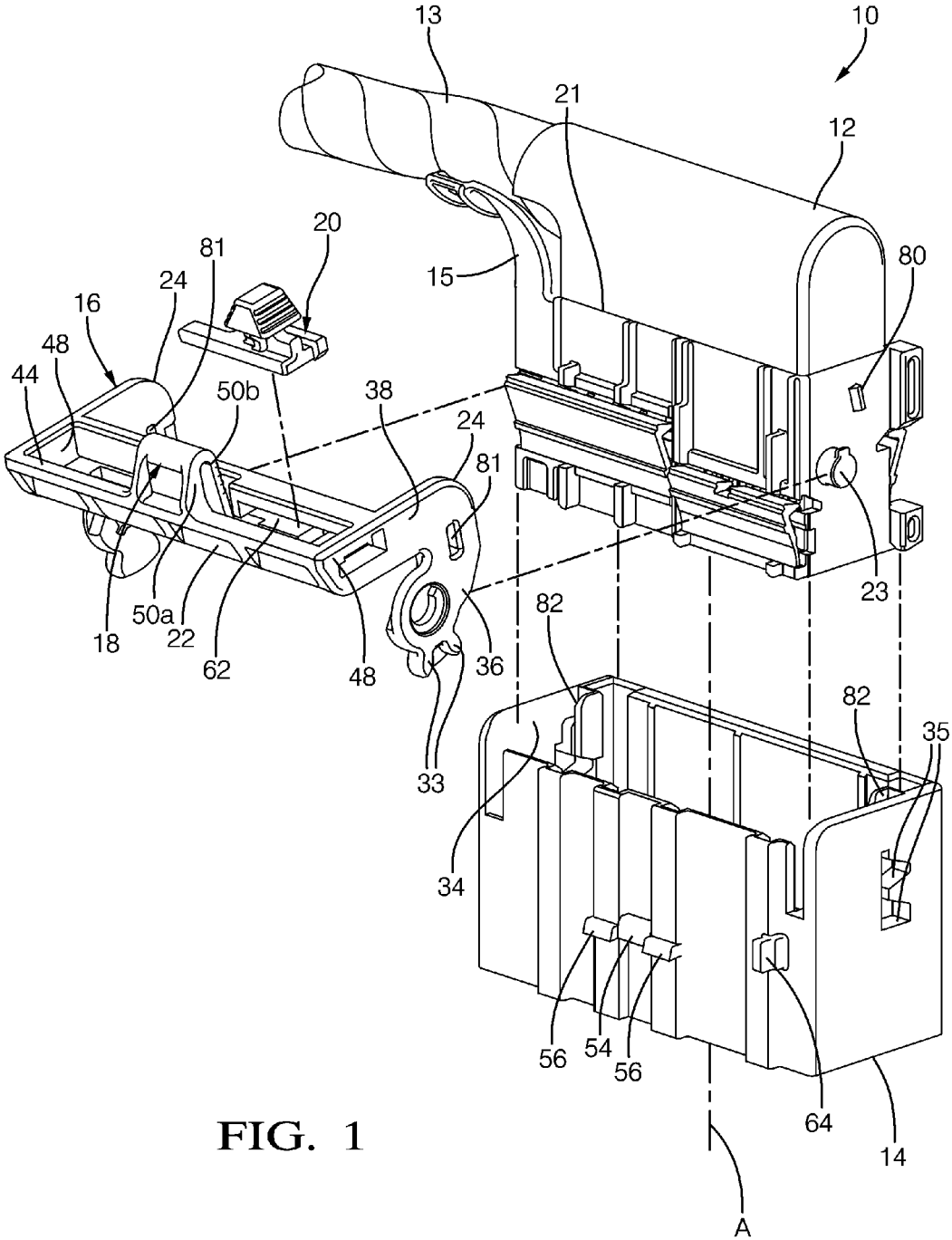
FIG. 1 is an exploded view of an electrical connection system that includes a mating assist lever (MAL) containing a locking means and a CPA member, according to the invention.

Lever arm electrical connection systems are used when large forces are needed to mate and unmate the housings and associated electrical contacts of the connection system. Often, these types of connection systems are utilized when a large number of electrical contacts, or terminals need to be electrically mated together within the connection system. In some motorized vehicular applications, the available space needed to mate a lever arm electrical connection system may be limited, or made less by other vehicle structures that may result in a close-fitting, hemmed-in type of environment in which to mate and unmate the lever electrical connection system. For example, vehicle structures such as adjacent interior walls or other electrical devices disposed within the vehicle may create this compact space environment. In other electrical applications, these walls or electrical devices may tightly adjacently surround two or three sides of a connection point for connector housings in a lever arm electrical connection system. In one such vehicular application, a wiring harness that contains a first connector housing of a lever arm electrical connection system mates to a second electrical connector housing in an area of the vehicle that has more limited space transverse to the mating axis in a volume of space required to positionally rotate the lever arm during the mating and unmating of the electrical connection system. Further, once the connector housings of the lever arm electrical connection system are mated and the lever arm successfully rotated, the access space to further lockingly secure the mated connector housings together and also latch a connector position assurance (CPA) member may also paradoxically be space constrained to an axial direction along a mating axis of the connector housings and/or one of the lateral sides of the lever arm electrical connection system, respectively. For example, mating/unmating of the lever arm electrical connection system may occur during vehicle assembly, during servicing of electrical devices in electrical communication in electrical communication with the lever arm electrical connection system during the service life of the vehicle, or during servicing of the lever arm electrical connection system should the lever arm electrical connection system itself need servicing.

The terms used in the instant specification have the following definitions.

Connector Position Assurance (CPA) member—Connector Position Assurance (CPA) member. The CPA member is disposed on a cross member of the MAL. The CPA member is slidingly moves along the MAL between an INOPERATIVE position and a LOCKED position. When disposed in the LOCKED position, the CPA member prevents a latched locking means from becoming inadvertently unlatched. This CPA member provides an additional layer of confidence to the user of the electrical connection system that the mated first and the second connector housings and with the corresponding mated electrical contacts will not respectively become unmated in an electrical application of use. The CPA member does not communicate with the first connector housing whether in the INOPERATIVE position, the LOCKED position, or being moved there between. The CPA member may be considered the secondary lock of the electrical connection system that ensures the locking means remains locked.

Locking Means—A locking means is disposed on a cross member of the MAL of the electrical connection system. The locking means operates between an INOPERATIVE state and LATCHED state. The locking means is operative to change between the INOPERATIVE state and the LATCHED state when the MAL is disposed in the CLOSED position. When disposed in the LATCHED state, the locking means secures the first connector housing to the second connector housing so that the first connector housing and its associated electrical contacts, respectively, do not inadvertently become unmated from the second connector housing and its associated mating electrical contacts. The locking means may be considered the primary lock of the electrical connection system that secures the first connector housing to the second connector housing together after mating thereto.

Mating Assist Lever (MAL)—The MAL operates in the electrical connection system between an INOPERATIVE position and a CLOSED position. When the MAL is not disposed in the CLOSED position, the MAL is disposed in a position along a rotation of travel on the first connector housing that is the INOPERATIVE position. Placement of the MAL in a PRE-STAGE location along the rotation of travel is part of the MAL being in the INOPERATIVE position. The MAL is disposed in the PRE-STAGE location after initial fabrication to ensure proper seating of the electrical connection system when the first connector housing that includes the MAL is mated with the second connector housing, such as may occur in a vehicle assembly plant during vehicle manufacture. When the first connector housing and its associated electrical contacts are partially mated with the second connector housing and its associated mating contacts, the MAL is configured for being movingly physically rotated to the CLOSED position, such that when rotated to the CLOSED position, the first connector housing and the second connector housing and the associated electrical contacts are fully mated and the MAL is physically located, or disposed so as to be positionally adjacent an external surface of the second connector housing. The electrical contacts respectively associated with the first and the second connector housing may be formed of an electrically conducting material, such as a metal material. The electrical contacts, or terminals may be formed from a sheet of metal material through a stamping process that is known in the electrical connection system art.

Figure 2:
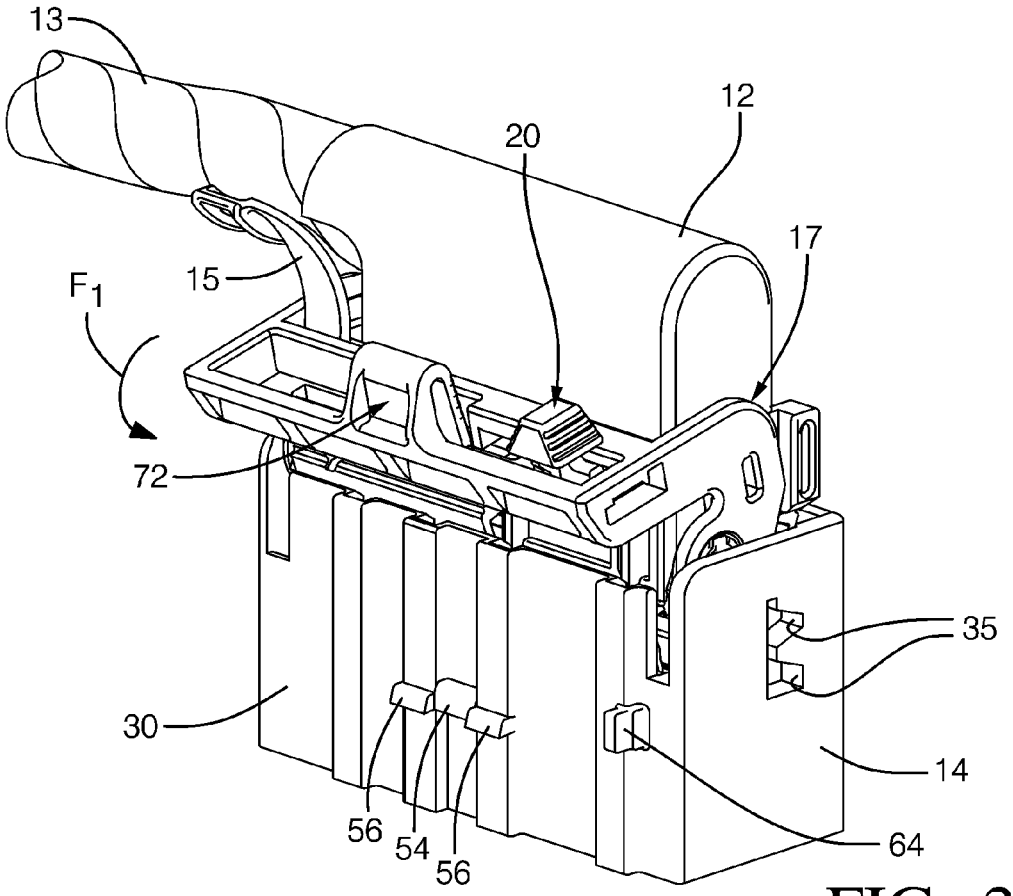
FIG. 2 is an isometric view in which a second connector housing is being mated to a first connector housing of the electrical connection system of FIG. 1, and the MAL is disposed in the INOPERATIVE position in a PRE-STAGE location.
Figure 3:
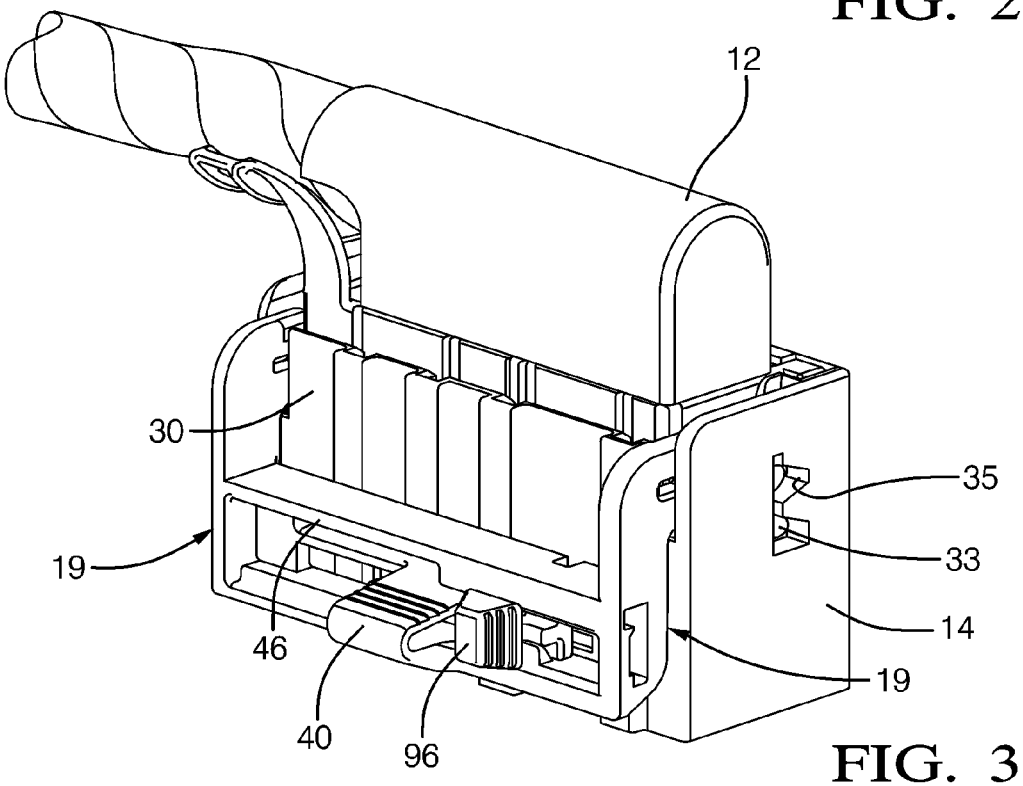
FIG. 3 is an isometric view in which the first connector housing is fully mated with the second connector housing of the electrical connection system of FIG. 2, and the MAL is disposed in the CLOSED position and the CPA member is disposed in the LOCKED position.
Figure 4:
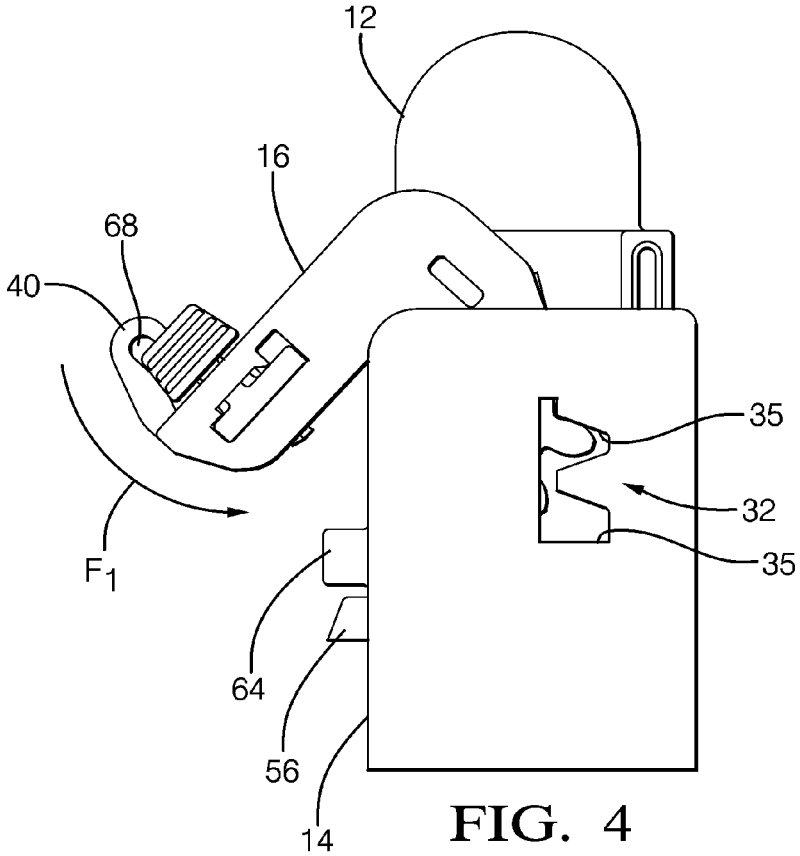
FIG. 4 is a side view of the electrical connection system of FIG. 2, and detail thereof pertaining to a rack-and-pinion system of the electrical connection system, and gear teeth of the MAL details thereof.

Referring to FIGS. 1-3 and in accordance with one embodiment of this invention, then, an electrical connection system 10 is presented that matingly operates and robustly performs in electrical applications, especially electrical applications having mating/unmating space constraints. Electrical connection system 10 includes a male, or first connector housing 12 and a female, or second connector housing 14 matable to first connector housing 12 along a mating axis A. Connector housings 12, 14 have a rectangular shape in a cross section view. Alternately, the housings may have any type of cross section shape dependent on the application of use. Connector housings 12, 14 are formed from a dielectric material, such as plastic, in an injection molding process. First connector housing 12 receives one or more electrical contacts (not shown) in electrical communication with a wiring harness 13 associated with a motorized vehicle (not shown) and second connector housing 14 receives one or more corresponding mating contacts (not shown). Wiring harness 13 is further supported by an arcuately shaped wire support 15 that extends from a rearward portion 21 of first connector housing 12. The electrical contacts, or terminals associated with the first and second connector housings are formed of an electrically conducting material, such as metal. The second connector housing may be associated with an electrical device disposed in the vehicle such as a bussed electrical center (BCM) or a sensing diagnostic module (SDM). Alternately, the second connector housing may also be integrally molded with a housing of the electrical device or fixedly attached to a substrate associated with the electrical device. Still yet alternately, the lever electrical connection system may be employed anywhere in the transportation industry, such as the trucking, marine, or airline industries, or in any type of electrical application where electrical devices need electrical connection especially in electrical applications that have compact mating space environments.

When first connector housing 12 mates with second connector housing 14, the respective associated electrical contacts, or terminals also become electrically connected together. First connector housing 12 includes MAL 16. MAL 16 further includes a locking means 18 disposed thereon. MAL 16 also further contains CPA member 20 disposed on MAL 16. More particularly, locking means 18 and CPA member 20 are each disposed on a cross portion 22 of MAL 16 that transitionally joins with lateral lever arms 24 of MAL 16 to form a U-shaped MAL 16. Lever arms 24 are pivotally mounted, or connected with first connector housing 12. MAL 16 is configured to positionally rotate between an INOPERATIVE position 17 and a CLOSED position 19. Locking means 18 is configured to communicate with second connector housing 14 to securingly latch first and second connector housings 12, 14 together during the mating process and CPA member 20 is configured to communicate with the latched locking means 18 to ensure that latched locking means 18 does not become prematurely unlatched during normal operation of electrical connection system 10. The features of latching locking means 18 and locking CPA member 20 ensure that the latched locking means 18 does not become unlatched. MAL 16, locking means 18, and CPA member 20 may be performed by a human operator, assembly operator, or a service technician even when electrical connection system 10 is employed in an electrical application having a very compact, tightly constrained space environment. CPA member 20 is configured to slidingly operate on cross portion 22 of MAL 16 in a direction transverse to mating axis A moving from an INOPERATIVE position 26 to a LOCKED position 28.

Referring to FIGS. 1-5, 12, and 13, a progression of the mating of the first housing connector to the second housing connector is illustrated and will now be described in greater detail. Referring to FIG. 1, first connector housing 12 is configured to be received by second connector housing 14 along mating axis A. Referring to FIG. 2, first housing connector 12 and the first connector housing's associated electrical contacts are initially matingly received by second connector housing 14 and the second connector housing's associated electrical contacts. Connector housings 12, 14 are partially mated and MAL 16 is disposed in its INOPERATIVE position 17. More particularly, referring to FIGS. 2 and 12, MAL 16 is disposed in a PRE-STAGE location to ensure an accurate mating experience when the first connector housing is eventually mated with the second connector housing. In the PRE-STAGE location a pre-stage lock tab 80 disposed on a respective external surface of lateral ends of second connector housing 14 insert in a pre-stage lock aperture, or window 81 defined on each of the lateral ends of lever arms 24 of MAL 16. In many embodiments, the MAL of the first connector housing is preferably shipped with a cable assembly being disposed in this PRE-STAGE location. When MAL 16 is disposed in its INOPERATIVE position 17, cross portion 22 is generally disposed remote from an external surface 30 of second housing connector 14. MAL 16 is pivotally connected to first connector housing 12 on a lateral protruding pins 23 disposed on different external surfaces of first connector housing 12. MAL 16 is configured to positionally movingly rotate on pins 23 with an applied first force $F_1$ so that gear teeth 33 engage a rack-and-pinion mechanism 32 in communication with second connector housing 14 as is known in the electrical connector arts to assist first connector housing 12 to be drawn into, and be further receiveably mated deeper in a cavity 34 of second connector housing 14. Rack-and-pinion mechanism 32 includes a pair of spaced apart gear teeth 33 that engage corresponding receiving ports 35 integrated in second connector housing 14 to aid in pullingly cinch first connector housing 12 and associated electrical contacts within second connector housing 14 and second connector housing's electrical contacts. Referring to FIG. 3, MAL 16 has been movingly rotated to CLOSED position 19 so that locking means 18 is disposed adjacent external surface 30 of second connector housing 14 while connector housings 12, 14 are fully mated together.

Figure 5:
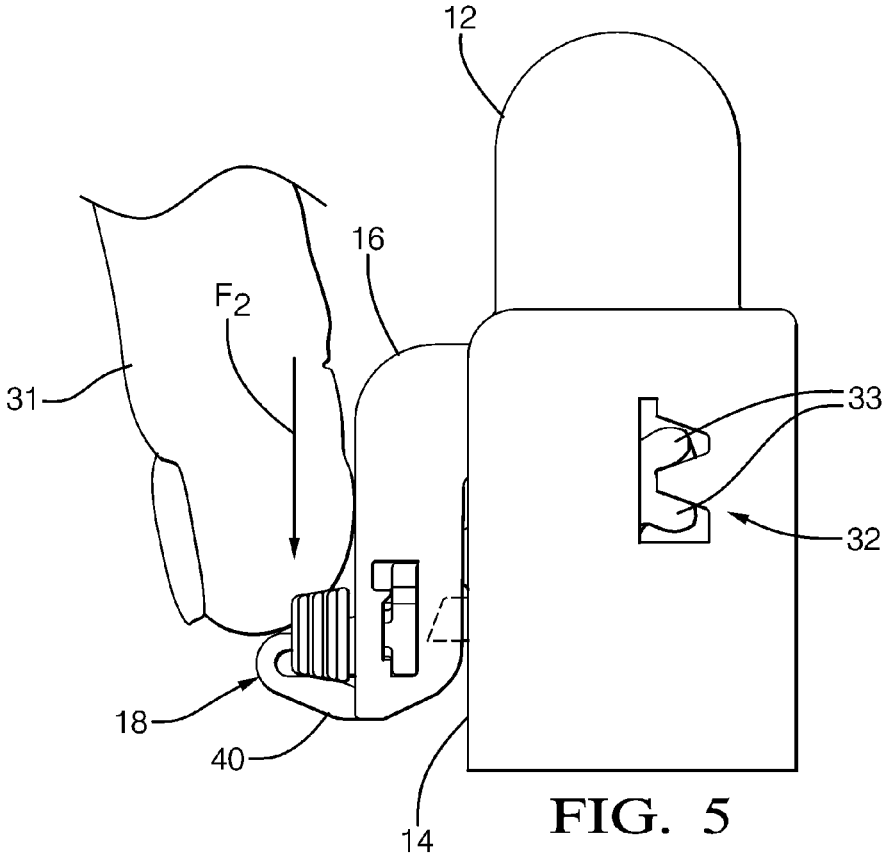
FIG. 5 is a side view of the electrical connection system of FIG. 3 and the locking means is disposed adjacent an external surface of the second connector housing and an axial force is applied against the locking means to secure the first connector housing to the second connector housing.

Referring to FIG. 5, a second force $F_2$ sufficiently axially-applied against locking means 18 actuates locking means 18 so that locking means 18 latchingly secures first connector housing 12 to second connector housing 14. Axially-applied force $F_2$ is applied in a direction axially away from first connector housing 12 towards a rearward section of cavity 34 of second connector housing 14. Force $F_1$ and $F_2$ may be applied with a finger 31 of a hand of human operator. In this manner, force $F_1$ and $F_2$ are applied to electrical connection system 10 external to electrical connection system 10. Additionally, force $F_1$ to rotate MAL 16 from INOPERATIVE position 17 to CLOSED position 19 is different that force $F_2$ needed to actuate locking means 18. Force $F_1$ is applied before force $F_2$ is applied. Force $F_3$ is applied after F2 has been applied.

Further features of the U-shaped MAL 16, locking means 18, and CPA member 20 will be now be described in greater detail below.

U-shaped MAL—Lever arms 24 of U-shaped MAL 16 each have a first section 36 and a second section 38. First section 36 pivotable connects with first connector housing 12 and also joins with second section 38 remote from the pivotable connection. First section 36 joins with second section 38 in a manner such that an angle Θ formed between first section 36 in relation to second section 38 is generally a 90 degree, or right angle. The right angle relationship of each of the lever arms 24 desirably allows for a tighter, compact rotation of MAL 16 between the INOPERATIVE and CLOSED positions 17, 19 which advantageously allows less space surrounding electrical connection system 10 to be needed to operate MAL 16. In other words, the swing path of MAL 16 is less than conventional lever arm electrical connection systems as previously described in the Background herein. The swing path radius is less which means that MAL 16 hugs closer to connector housings 12, 14 during MAL rotation.

Because MAL 16 needs less a less volume of space for rotation to CLOSED position 19 from the INOPERATIVE position 17, this ensures electrical connection system 10 is better suited for operation in a more constrained space environment over other conventional lever arm electrical systems that do not have this feature.

Figure 8:
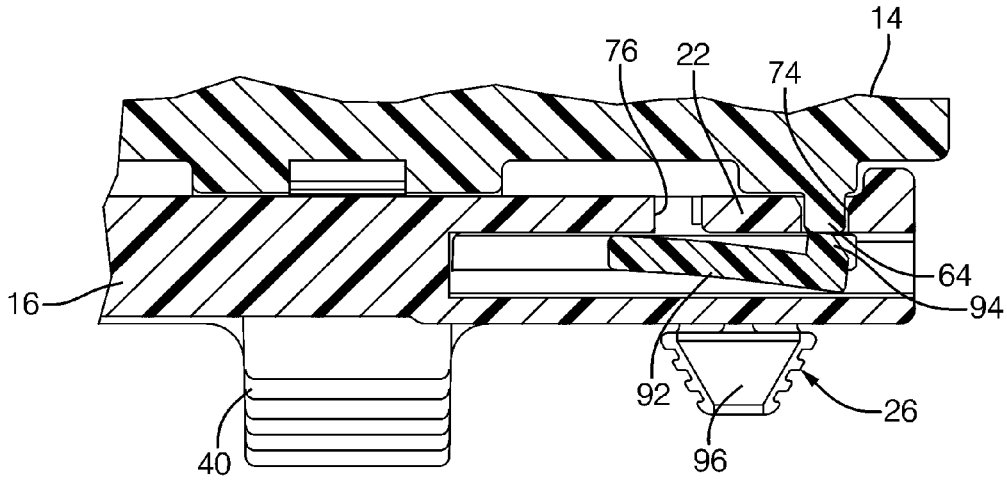
FIG. 8 is a lateral cross section view of the cross portion of the MAL disposed in the CLOSED position of FIG. 6 through the lines 8-8 with the CPA member disposed in the INOPERATIVE position, showing further CPA member interaction details thereof.

Locking means disposed on MAL—Turning our attention now to FIGS. 4-10, locking means 18 comprises a U-shaped element 40 associated with U-shape MAL 16. An open end 42 of U-shaped element 40 generally faces towards external surface 30 of second connector housing 14. A generally rigid beam 44 and a generally flexible beam 46 span laterally across cross portion 22 being in connected communication with lateral ends 48 of cross portion 22. Rigid beam 44 has a somewhat greater cross section thickness than flexible beam 46 giving rigid beam 44 more rigidity and less flexibility, or resiliency than flexible beam 46. One leg 50*a* of U-shaped element 40 communicates with rigid beam 44 and the other leg 50*b* of U-shaped element communicates with flexible beam 46. Flexible beam 46 further includes a tab 52 that extends outwardly away from flexible beam 46. When first connector housing 12 is mated to second connector housing 14 and MAL 16 is rotated to CLOSED position 19 and force $F_2$ is applied against U-shaped element 40, flexible beam 46 movingly flexes such that tab 52 clears a fixed locking tab 54 disposed on external surface 30 of second connector housing 14 to latchingly secure first connector housing 12 to second connector housing 14. Referring to FIG. 2, when locking means 18 is disposed away from external surface 30, locking means 18 is disposed in the INOPERATIVE position 72. Referring to FIG. 8, when locking means 18 is adjacent external surface and force F2 has been applied so locking means 18 is latched, locking means 18 is disposed in the LATCHED position 70.

External surface 30 of second connector housing 14 includes a pair of lateral nubs 56 spaced apart by fixed locking tab 54. When first connector housing 12 is mated to second connector housing 14 and MAL 16 is rotated to CLOSED position 19 and force $F_1$ is applied against U-shaped element 40, as best illustrated in FIG. 5, flexible beam 46 movingly flexes such that tab 52 clears fixed locking tab 54 to reside against a fixed locking tab 54 and a portion of flexible beam 46 adjacent the location of tab 52 clears the pair of lateral nubs 56 to engagingly reside against the pair of lateral nubs 56 to latchingly secure first connector housing 12 to second connector housing 14. When tab 52 clears fixed locking tab 54, an audible 'click' type sound may often be heard by the ear of a human assembly operator. This advantageously is another indication that locking means 18 has secured first connector housing 12 with second connector housing 14. Lateral nubs 56 extend a further distance outwardly away from external surface 30 of second connector housing 14 than fixed locking tab 54. This allows lateral nubs 56 to further buttress flexible beam 46 when tab 52 clears fixed locking tab 54 so first connector housing 12 is latchingly secured to second connector housing 14.

Figure 6:
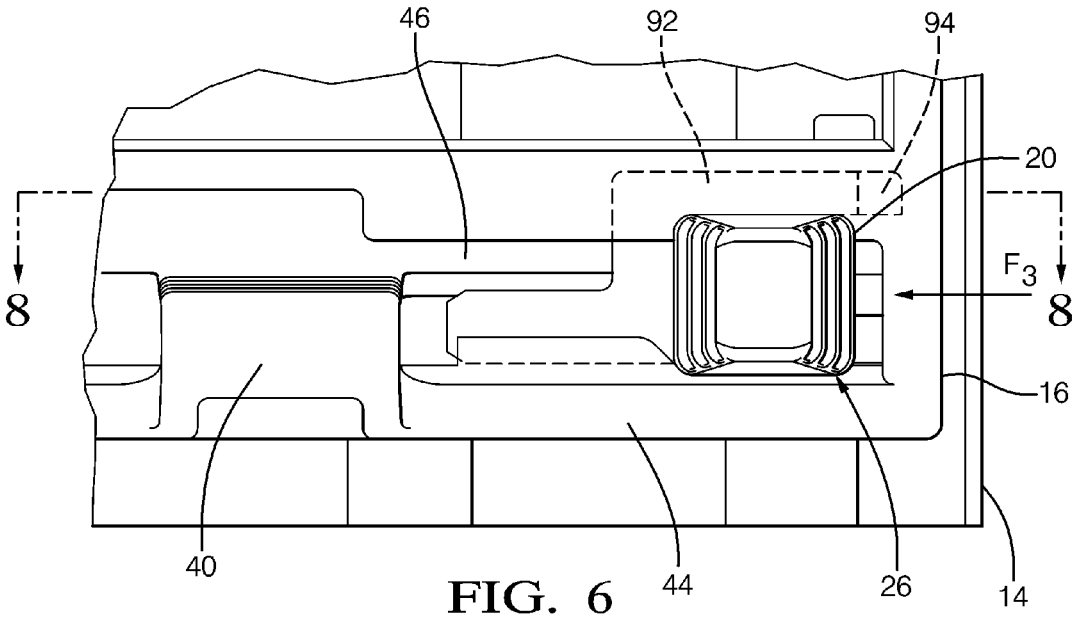
FIG. 6 is a topical view of a cross portion of the MAL of the electrical connection system of FIG. 3, and the CPA member is disposed in the INOPERATIVE, PRE-STAGED position.
Figure 7:
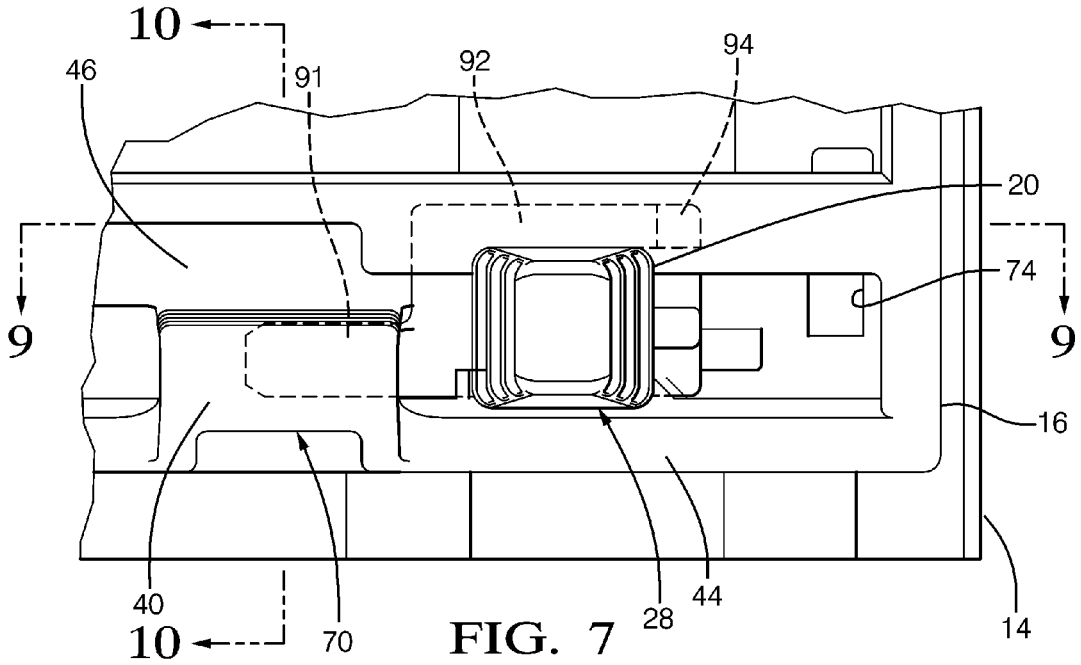
FIG. 7 is a topical view of the cross portion of the MAL of the electrical connection system of FIG. 3, and the CPA member is disposed in the LOCKED position after the locking means has been disposed in the LATCHED position.

CPA Member disposed on MAL—Referring to FIGS. 6-11, CPA member 20 is slidably mounted on a track 62 of MAL 16 and is configured to slide along track 62 in a direction transverse to mating axis A between INOPERATIVE position 26 and LOCKED position 28. Referring to FIG. 6, CPA member 20 moves with an applied force $F_3$, such as may also be applied with finger 31 of a hand of a human operator or service technician. When CPA member 20 is disposed in LOCKED position 28, CPA member 20 prevents displacement of the latched locking means 18. CPA member 20 slidably moves in track 62 along the MAL in a left-to-right direction for disposal in LOCKED position 28 from INOPERATIVE position 26, the left-to-right direction being in relation to a reference point of viewing rearward portion 21 of first connector housing 12 when first connector housing 12 and the second connector housing 14 are mated together. Alternately, the levered electrical connection system may be constructed so that the CPA member may be slidably moved in the track to the LOCKED position in a direction traverse to mating axis A from a right-to-left direction.

Figure 11:
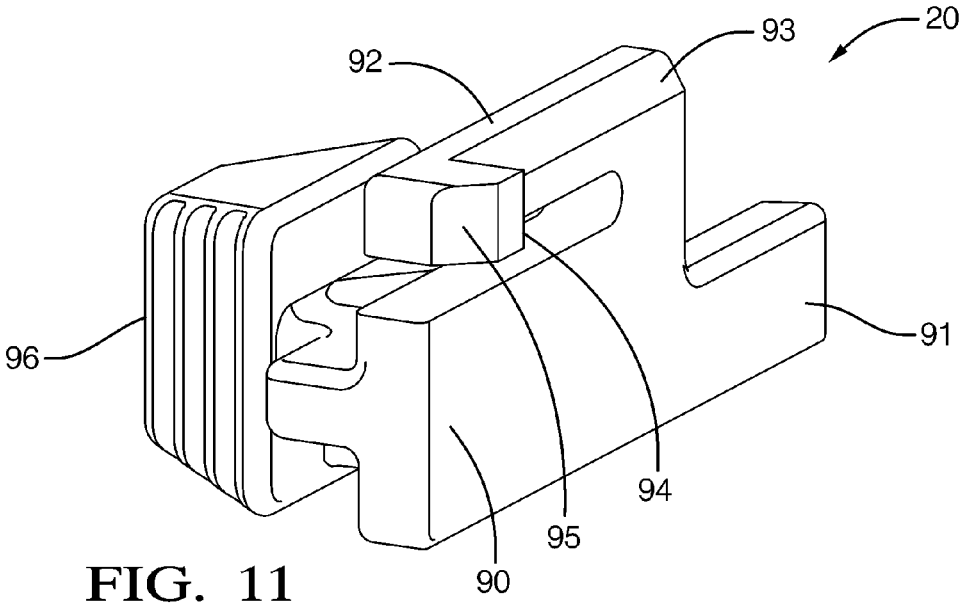
FIG. 11 is a isometric view of the CPA member removed from the MAL of the electrical connection system of FIG. 1, and details thereof.

CPA member 20, as best illustrated in FIG. 11, is shown removed from MAL 16. CPA member 20 includes a generally planar base member 90. A protruding button 96 overlies, extends away from, and communicates with base member 90. An engagement end 91 extends away from base member 90 and is configured to engage area 68 enclosed by U-shaped element 40 when CPA member 20 is disposed in LOCKED position 28. A L-shaped flexible arm 92 also extends away from base member 90 in a direction opposite engagement end 91. At the end of flexible arm 92 is disposed a flexible arm nub 94 that extends outwardly away from flexible arm 92 in a transverse direction away from base member 90. Nub 94 is configured to engagingly fit in to first aperture 74 when CPA member 20 is disposed in INOPERATIVE position 26. Nub 94 is configured to engagingly fit in to second aperture 76 when CPA member 20 is disposed in the LOCKED position 28. Flexible arm 92 applies a sufficient tension to ensure nub 94 fits, or engages at least one of the apertures 74, 76. Flexible arm 92 includes an angled, beveled portion 93 disposed along a majority portion of the length of flexible arm 92. Beveled portion 93 assists an assembly operator to initially install CPA member 20, as best illustrated in FIG. 11, to properly flexingly seat in to track 62 when first connector housing 12 is assembled. Angled portion 95 facilitates movement of CPA member 20 from LOCKED position 28 to INOPERATIVE position 26 along track 62 when a force generally opposite force $F_3$ is applied against protruding button 96 of CPA member 20. Angled portion 95 assists to aid CPA member 20 to enter track 62 being removed from second aperture 76 while further overcoming a frictional resistance of track 62 when the force generally opposite force $F_3$ is applied so that CPA member 20 is moveable along track 62. CPA member 20 may be formed of a similar material to that of connector housings 12, 14, as previously described herein. The movement of CPA member 20 is in a direction that is different from the direction of the applied force $F_2$ needed to latch locking means 18 to secure first connector housing 12 to the second connector housing 14 is also advantageous to allow mating of the connector housings 12, 14 in a less amount of space in contrast to conventional lever electrical connection systems as previously described in the Background herein. For connector housings 12, 14 to be unmated, a force applied against CPA button 96 is needed to move CPA member 20 along track 62 from LOCKED position 28 to the INOPERATIVE position 26. This force is needed to overcome a retention force applied along beveled portion 93 and allow movement of CPA member 20 along track 62 to INOPERATIVE position 26. Again, it should be noted that the forces $F_1$, $F_2$, and $F_3$ may be sufficiently applied with a single finger of a human hand to operate MAL 16, locking means 18, and CPA member 20. Alternately, the actual force values for forces $F_1$, $F_2$, and $F_3$ are dependent on the electrical application of use.

Figure 9:
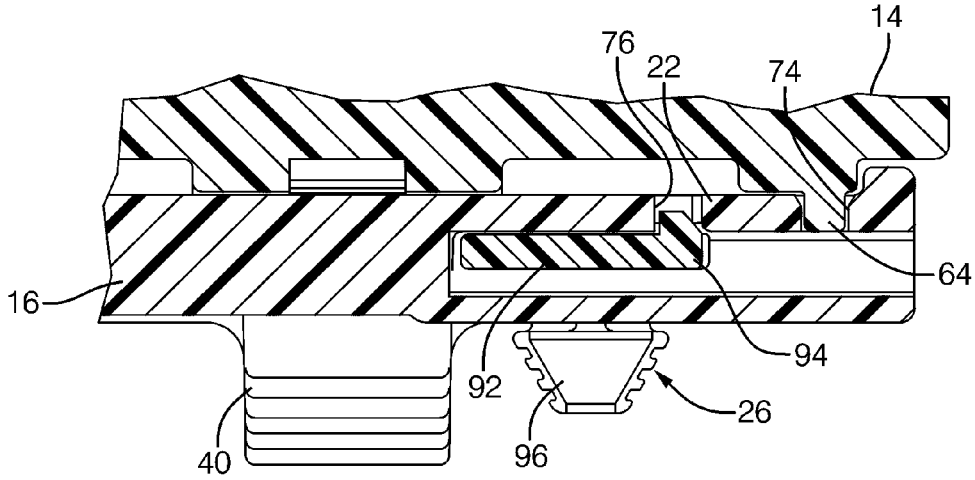
FIG. 9 is a lateral cross section view of the cross portion of the MAL disposed in the CLOSED position of FIG. 7 through the lines 9-9 with the CPA member disposed in the LATCHED position, showing further CPA member interaction details thereof.
Figure 10:
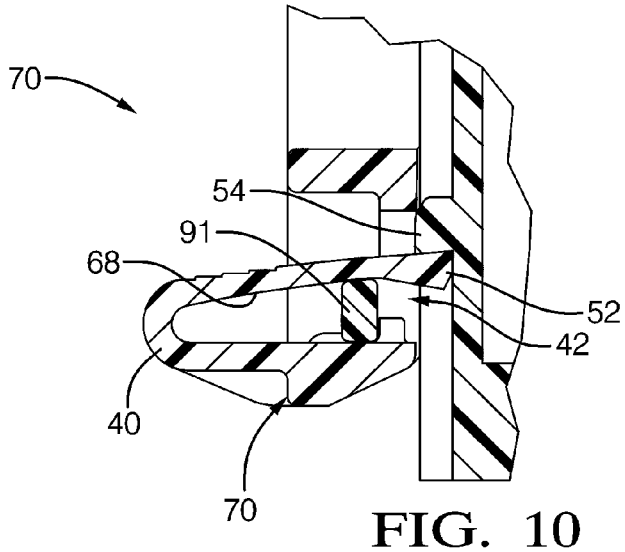
FIG. 10 is a cross section view of the locking means disposed on the cross portion of the MAL disposed in the CLOSED position of FIG. 6 through the lines 10-10.

Referring to FIGS. 1, 8, and 9, second connector housing 14 comprises a raised displacement protuberance 64 disposed on the external surface 30 of second connector housing 14. When MAL 16 is disposed in CLOSED position 19, protuberance 64 is received through a first aperture 74, as best illustrated in FIG. 9. As protuberance 64 is received in first aperture 74, protuberance 64 engages a flexible arm nub 94 of CPA member 20 so as to displacingly urge nub 94 out and away from first aperture 74. Because nub 94 is urged away from first aperture 74, CPA member 20 is now relatively free for movement in track 62 from INOPERATIVE position 26 to LOCKED position 28 when a force is applied to protruding button 96 in a direction towards second aperture 76. Additionally, engagement end 91 of CPA member 20 is configured to engagingly be received through an area 68 enclosed by the U-shaped element 40 of locking means 18 when CPA member 20 is disposed in LOCKED position 28. When locking means 18 latchingly secures first connector housing 12 to the second connector housing 14 and CPA member 20 is disposed in LOCKED position 28, and hence nub 94 being disposed in second aperture 76, U-shaped element 40 is prevented from moving in to the INOPERATIVE position 26 thereby desirably keeping first connector housing 12 from unmating from second connector housing 14.

Figure 12:
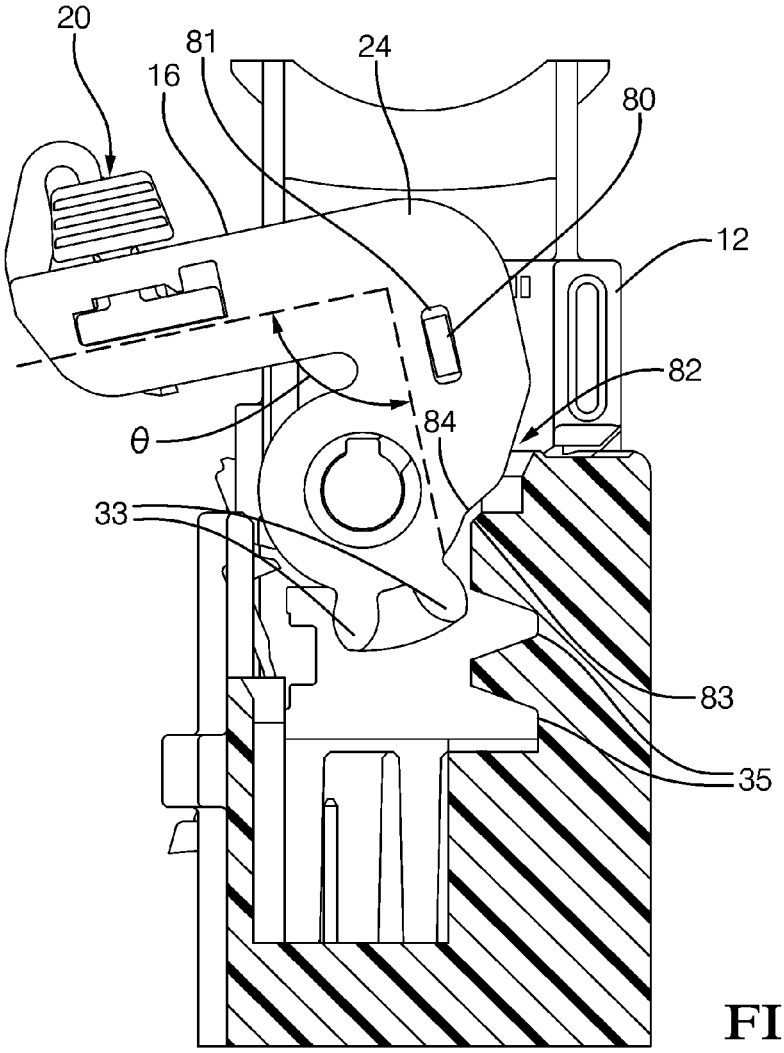
FIG. 12 is a side view of the electrical connection system of FIG. 2, showing rack-and-pinion details thereof.

Referring to FIG. 12, a portion of the rack-and-pinion mechanism 32 is illustrated. MAL 16 is disposed in the PRE-STAGE location. As previously described herein, the INOPERATIVE POSITION of MAL 16 includes MAL 16 being disposed in the PRE-STAGE location. The PRE-STAGE location includes pre-stage lock tab 80 of first connector housing 12 being disposed in pre-stage lock window 81 defined in lever arms 24. Referring to FIGS. 1 and 12, lock tab 80 is disposed on both lateral ends of first connector housing 12 and lock window 81 is defined in each lever arm 24. MAL 16 disposed in lock tab 80 provides a positive lock to keep MAL 16 in the PRE-STAGE location until such time as first connector housing 12 is mated with second connector housing 14, such as may occur at a vehicle assembly plant that may be remote from where first connector housing 12 is manufactured. Lock tab 80 and window 81 are disposed at a location so that gear teeth 33 are at the correct position so that first connector housing 12 is ready for mating with second connector housing 14 so that gear teeth 33 mesh in a proper manner with receiving ports 35 when MAL 16 is unlocked from its PRE-STAGE location when first connector housing 12 is disposed in cavity 34 of second connector housing 14 during mating of first and second connector housing 12, 14. It should be noted that a uniform force is exerted along the entire first connector housing perpendicular to mating axis A as the rack-and-pinion mechanism 32 is disposed on each side of lateral arms 24 of MAL 16.

MAL 16 is unlocked from the PRE-STAGE location when, as first connector housing 12 is inserted in cavity 34 of second connector housing 14, pre-stage lock release tab 82 exerts a outward pressure against lever arms 24 of MAL 16 to outwardly spread lever arms 24 in a lateral direction to first connector housing 12 to sufficiently lift lever arms 24 away from, and off of lock tab 80. At the time MAL 16 is released from the PRE-STAGE location, an edge 83 of pre-stage lock release tab 82 contacts an edge 84 of lever arms 24 of MAL 16 which causes MAL 16 to begin to rotate in a counterclockwise direction towards CLOSED position 19 and gear teeth 33 begin to mesh with receiving ports 35 so that energy to mate the connector housings 12, 14 together is transferred to the second connector housing 14. Gear teeth 33 fully mesh into ports 35 when MAL 16 is disposed in CLOSED position 19, as best illustrated in FIG. 3. In one embodiment, a force applied against the wire bundle once the first connector housing is disposed in the cavity of the second connector housing will enable the MAL to positionally exit the PRE-STAGE location and begin rotation to the CLOSED position.

Electrical connection system 10 is not in use when first connector housing 12 is not mated with second connector housing 14.

Electrical connection system 10 is partially in use when first connector housing 12 is mated with second connector housing 14 and MAL 16 is disposed in INOPERATIVE position 26, as best illustrated in FIG. 2. When partially in use, electrical signals may be carried though the electrical connector system as electrical contacts disposed in the first connector housing may make electrical contact with corresponding electrical contacts of the second connector housing.

Electrical connection system 10 is in use when first connector housing 12 is mated with second connector housing 14, MAL 16 is disposed in CLOSED position 19, locking means 18 is in the LATCHED state, and CPA member 20 is disposed in LOCKED position 28.

Figure 13:
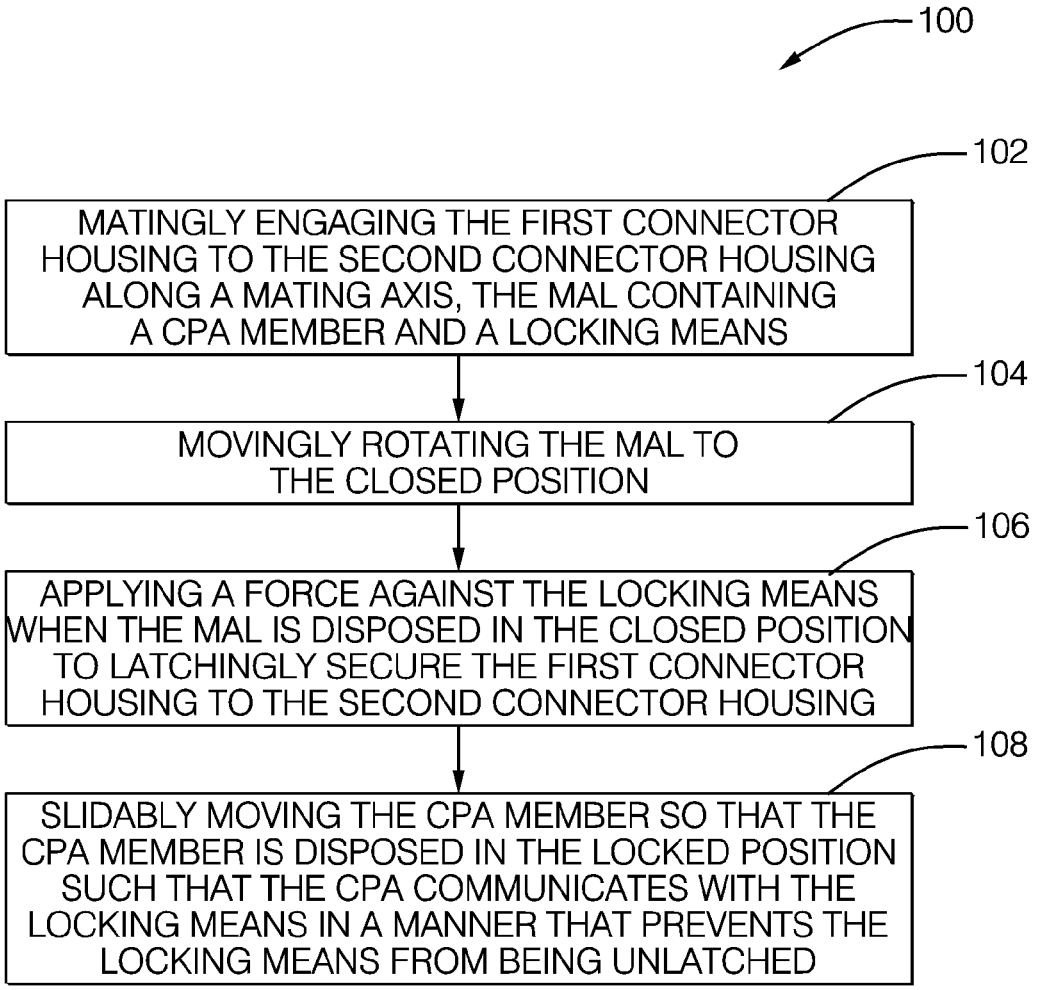
FIG. 13 is a method block diagram to mate the first connector housing of FIG. 1 to the second connector housing of FIG. 1 to form the electrical connection system of FIG. 3.

Referring to FIG. 13, a method 100 of mating first connector housing 12 to second connector housing 14 to form electrical connection system 10 is presented. Method 100 encompasses taking electrical connection system 10 progressively from being not in use to being partially in use and then from being partially in use to being in use, as described previously herein. One step 102 in method 100 is matingly engaging first connector housing 12 to second connector housing 14 along mating axis A. Another step 104 in method 100 is movingly rotating MAL 16 to CLOSED position 19 such that locking means 18 is disposed adjacent to external surface 30 of second connector housing 14. A further step 106 in method 100 is applying force $F_2$ against locking means 18 when MAL 16 is disposed in CLOSED position 19 that is sufficient to latchingly secure first connector housing 12 to second connector housing 14. A further step 108 in method 100 is slidably moving CPA member 20 so that CPA member 20 is disposed in LOCKED position 28 such that engagement end 91 of CPA member 20 engages and fills area 68 enclosed by U-shaped element 40 in a manner that prevents latched locking means 18 from being unlatched.

If the steps 102, 104, 106, 108 in method 100 are generally conducted in the reverse order, the connector housings 12, 14 may be unmated from each other. A force applied against CPA member 20, generally opposite force $F_3$ and applied with index finger 31 moves CPA member 20 from LOCKED position 28 to INOPERATIVE position 26. The force applied to CPA member needs to be sufficient to allow angled portion 95 assist nub 94 out from second aperture 76 to slidingly glide along track 62. This allows a force applied against U-shaped element 40 in a direction opposite to force $F_2$ to unsecure locking means 18 so that first connector housing 12 is configured to unmate from the second connector housing 14. Next, a force applied in a direction opposite to force $F_1$ as illustrated in FIG. 2 is applied to MAL 16 to movingly rotate MAL 16 from CLOSED position 19 to INOPERATIVE position 17 away from external surface 30 of second connector housing 14. First connector housing 12 is then configured for unmating from the second connector housing 14 by pulling first connector housing 12, such as with a human hand of a service technician, away from second connector housing 14.

Thus, a lever arm electrical connection system that includes an MAL that positionally rotates in less space yet also includes both a locking means and a connector position assurance (CPA) member that work in combination to ensure a first connector housing does not inadvertently unmate from a second connector housing has been presented. The locking means and the CPA member robustly operatively perform in combination on the MAL to allow unencumbered, multiple matings/unmatings of the connector housings of the lever arm electrical connection system in product applications that utilize the lever arm electrical connection system. The lever arm electrical connection system robustly performs in many electrical applications and especially those having constrained space environments for mating and unmating of the connector housings. The right angled construction of the lever arms of the MAL allow the MAL to rotate in a less amount of space so that the lever arm may operatively performs in an electrical application that has a compacted space. The locking means and the CPA member disposed on a cross portion of the MAL member, respectively, assist to advantageously allow latching of the locking means from a single side of the electrical connection system should an electrical application require it. This levered connection system is especially an advantage when other sides of the connection system contain other structures, or electrical devices of the vehicle that at least partially surround the electrical connection system and do not allow easy access to mate and unmate the connection system from these directions. The locking means latches the first connector housing to the second connector housing by applying a force separately applied after application of a different force to rotate the MAL to the CLOSED position. The forces applied to operate the MAL, the locking means, and the CPA lock may be simply applied by a single index finger of the human hand. The force applied to the CPA member to position the CPA member in the LOCKED position so that an engagement end of the CPA member protrudes through and fills an area enclosed by the U-shaped element of the locking means keeps the U-shaped element of the locking means from becoming unlatched. This feature ensures the first connector housing does not inadvertently unmate from the second connector housing. The connector housings, the MAL, the locking means, and the CPA member may all be formed from dielectric materials, preferably plastic material that may be injection molded and subsequently assembled in a production process to construct the electrical connection system. The electrical connection system formed from a plastic material is preferred in that the pieces of the electrical connection system may all be molded by an injection molding process. The MAL of the electrical connection system may be disposed in a PRE-STAGE location for ease of shipping of the first connector housing that also ensures an initial, accurate robust mating of the first connector housing to the second connector housing when mating of the first and second connector housing occurs.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connection system including a first connector housing containing associated electrical contacts and a second connector housing containing associated mating electrical contacts configured to mate with the first connector housing and the first connector housing's associated electrical contacts along a mating axis, and the first connector housing further includes a mating assist lever pivotally mounted to the first connector housing and configured to rotationally pivot between an INOPERATIVE position and a CLOSED position, the electrical connection system comprising:

a locking means disposed on said mating assist lever, wherein when the mating assist lever is movingly rotated to the CLOSED position so that the first connector housing and the second connector housing are mated together and the locking means is disposed adjacent the second connector housing, a force sufficiently applied against the locking means actuates the locking means so that the locking means latchingly secures the first connector housing to the second connector housing; and a connector position assurance member slidably mounted on the mating assist lever and configured to slide in a direction transverse to the mating axis between an INOPERATIVE position and a LOCKED position, and wherein said connector position assurance member prevents displacement of said latched locking means when the connector position assurance member is disposed in the LOCKED position.

2. The electrical connection system according to claim 1, wherein a first force is applied to movingly rotate said mating assist lever to the CLOSED position and said force applied against the locking means is a second force and wherein said second force is different from said first force.

3. The electrical connection system according to claim 2, wherein said second force comprises an axially-applied force.

4. The electrical connection system according to claim 1, wherein the second connector housing comprises a lever arm disposed on an external surface of the second connector housing and wherein a portion of the connector position assurance member communicates with the lever arm such that the lever arm prevents the first connector housing from unmating from the second connector housing when the connector position assurance member is disposed in the LOCKED position.

5. The electrical connection system according to claim 1, wherein said mating assist lever is U-shaped and comprises a pair of lever arms joined by a cross portion and wherein said locking means is disposed on said cross portion.

6. The electrical connection system according to claim 5, wherein at least one lever arm in said pair of lever arms comprises a first section and a second section, wherein the first section joins with the second section in a manner such that an angle is formed between the first section in relation to the second section and wherein said angle is generally a right angle.

7. The electrical connection system according to claim 1, wherein said locking means comprises a U-shaped element and wherein an open end of the U-shaped element generally faces towards the electrical connection system when the first connector housing is mated with the second connector housing.

8. The electrical connection system according to claim 1, wherein said locking means comprises, a generally rigid beam, a generally flexible beam spaced apart from the rigid beam, and a U-shaped element, wherein a first end of said U-shaped element communicates with the fixed beam and a second end of said U-shaped element communicates with the flexible beam.

9. The electrical connection system according to claim 8, wherein the flexible beam further includes a tab that extends outwardly away from the flexible beam and wherein the flexible beam movingly flexes such that the tab clears a fixed locking tab disposed on an external surface of the second connector housing to latchingly secure the first connector housing to the second connector housing when the first connector housing is mated to the second connector housing, the mating assist lever is rotated to the CLOSED position, and said force is applied against the U-shaped element.

10. The electrical connection system according to claim 9, wherein the external surface of the second connector housing includes a pair of lateral nubs spaced apart by the fixed locking tab, wherein the flexible beam movingly flexes such that the tab clears the flexible tab nub and the flexible beam clears the pair of lateral nubs disposed on the external surface of the second connector to latchingly secure the first connector housing to the second connector housing when the first connector housing is mated to the second connector housing, the mating assist lever is rotated to the CLOSED position, and said sufficient force is applied against the U-shaped element, and wherein said respective pair of lateral nubs extend a further distance away from the external surface of the second connector than the fixed locking tab.

11. The electrical connection system according to claim 2, wherein the locking means comprises a U-shaped element that is configured to receive said second force, wherein the mating assist lever further includes the connector position assurance member configured to engage through an area enclosed by the U-shaped element when the connector position assurance member is disposed in the LOCKED position so that the locking means is prevented from moving in to the INOPERATIVE position thereby keeping the first connector housing from unmating from the second connector housing when the locking means latchingly secures the first connector housing to the second connector housing and the connector position assurance member is disposed in the LOCKED position.

12. The electrical connection system according to claim 11, wherein the second connector housing comprises a lever arm disposed on an external surface of the second connector housing and wherein a portion of the connector position assurance member engages said lever arm so that the first connector housing is prevented from unmating from the second connector housing when the connector position assurance member is disposed in the LOCKED position.

13. The electrical connection system according to claim 1, wherein at least a portion of the electrical connection system is associated with a wiring harness disposed in a motorized vehicle.

14. A method of mating a first connector housing to a second connector housing to form an electrical connection system, comprising:

matingly engaging the first connector housing to the second connector housing along a mating axis, and the first connector housing includes a mating assist lever, wherein the mating assist lever contains a connector position assurance member and a locking means, and wherein the mating assist lever is configured to movingly rotate to a CLOSED position and the connector position assurance member is configured to slidingly move to a LOCKED position;

movingly rotating the mating assist lever to the CLOSED position such that the locking means is disposed adjacent to an external surface of the second connector housing;

applying a force against the locking means when the mating assist lever is disposed in the CLOSED position that is sufficient to latchingly secure the first connector housing to the second connector housing; and slidably moving the connector position assurance member in a direction transverse to the mating axis so that the connector position assurance member is disposed in the LOCKED position such that the connector position assurance member communicates with said locking means in a manner that prevents said latched locking means from being unlatched.

15. The method according to claim 14, wherein the step of movingly rotating the mating assist lever to the CLOSED position is applied with a first force and the step of applying the force against the locking means is applied with a second force different from the first force and wherein the second force is applied after said first force.

16. The method according to claim 14, wherein the mating assist lever is U-shaped and includes a pair of levers arms joined together by a cross portion and wherein the connector position assurance member and the locking means, respectively, are disposed on the cross portion.

17. A method of mating a first connector housing to a second connector housing to form an electrical connection system, comprising:

matingly engaging the first connector housing to the second connector housing along a mating axis, and the first connector housing includes a mating assist lever, wherein the mating assist lever contains a connector position assurance member and a locking means, and wherein the mating assist lever is configured to movingly rotate to a CLOSED position and the connector position assurance member is configured to slidingly move to a LOCKED position;

movingly rotating the mating assist lever to the CLOSED position such that the locking means is disposed adjacent to an external surface of the second connector housing;

applying a force against the locking means when the mating assist lever is disposed in the CLOSED position that is sufficient to latchingly secure the first connector housing to the second connector housing; and slidably moving the connector position assurance member so that the connector position assurance member is disposed in the LOCKED position such that the connector position assurance member communicates with said locking means in a manner that prevents said latched locking means from being unlatched, wherein the mating assist lever is U-shaped and includes a pair of levers arms joined together by a cross portion, wherein the connector position assurance member and the locking means, respectively, are disposed on the cross portion and wherein the locking means comprises a U-shaped element in communication with a flexible beam and a rigid beam, and the flexible beam and the rigid beam, respectively, are associated with the cross portion of the mating assist lever.

18. A method of mating a first connector housing to a second connector housing to form an electrical connection system, comprising:

matingly engaging the first connector housing to the second connector housing along a mating axis, and the first connector housing includes a mating assist lever, wherein the mating assist lever contains a connector position assurance member and a locking means, and wherein the mating assist lever is configured to movingly rotate to a CLOSED position and the connector position assurance member is configured to slidingly move to a LOCKED position;

movingly rotating the mating assist lever to the CLOSED position such that the locking means is disposed adjacent to an external surface of the second connector housing;

applying a force against the locking means when the mating assist lever is disposed in the CLOSED position that is sufficient to latchingly secure the first connector housing to the second connector housing; and slidably moving the connector position assurance member so that the connector position assurance member is disposed in the LOCKED position such that the connector position assurance member communicates with said locking means in a manner that prevents said latched locking means from being unlatched wherein the locking means includes a tab, and wherein the tab clears a nub disposed on the external surface of the second connector housing so that the tab communicates with a shoulder of the nub so that the first connector housing is latchingly secured to the second connector housing.

19. A method of mating a first connector housing to a second connector housing to form an electrical connection system, comprising:

matingly engaging the first connector housing to the second connector housing along a mating axis, and the first connector housing includes a mating assist lever, wherein the mating assist lever contains a connector position assurance member and a locking means, and wherein the mating assist lever is configured to movingly rotate to a CLOSED position and the connector position assurance member is configured to slidingly move to a LOCKED position;

movingly rotating the mating assist lever to the CLOSED position such that the locking means is disposed adjacent to an external surface of the second connector housing;

applying a force against the locking means when the mating assist lever is disposed in the CLOSED position that is sufficient to latchingly secure the first connector housing to the second connector housing; and slidably moving the connector position assurance member so that the connector position assurance member is disposed in the LOCKED position such that the connector position assurance member communicates with said locking means in a manner that prevents said latched locking means from being unlatched wherein the locking means includes a U-shaped element, wherein an end portion of the connector position assurance member communicates with an area that is enclosed by the U-shaped element when the connector position assurance member is disposed in the LOCKED position and wherein-a portion of the connector position assurance member that is different from said end portion communicates with a lever arm disposed on the second connector housing when the connector position assurance member is disposed in the LOCKED position.

20. The method according to claim 16, wherein the locking means comprises a U-shaped element in communication with a flexible beam and a rigid beam, and the flexible beam and the rigid beam, respectively, are associated with the cross portion of the mating assist lever.

21. The method according to claim 14, wherein the locking means includes a tab, and wherein the tab clears a nub disposed on the external surface of the second connector housing so that the tab communicates with a shoulder of the nub so that the first connector housing is latchingly secured to the second connector housing.

22. The method according to claim 14, wherein the locking means includes a U-shaped element, wherein an end portion of the connector position assurance member communicates with an area that is enclosed by the U-shaped element when the connector position assurance member is disposed in the LOCKED position and wherein-a portion of the connector position assurance member that is different from said end portion communicates with a lever arm disposed on the second connector housing when the connector position assurance member is disposed in the LOCKED position.

* * * * *